US005887240A

United States Patent [19]

Fournier et al.

[11] Patent Number: 5,887,240

[45] Date of Patent: Mar. 23, 1999

[54] METHOD OF MANUFACTURING A PLATINUM ELECTRODE

[75] Inventors: Robert Gregory Fournier, Burton; Frederick Lincoln Kennard, III, Holly, both of Mich.

[73] Assignee: General Motors Corporation, Detroit, Mich.

[21] Appl. No.: 75,585

[22] Filed: May 11, 1998

[51] Int. Cl.[6] ..... B22F 7/04

[52] U.S. Cl. ..... 419/9; 419/10

[58] Field of Search ..... 419/9, 10; 252/514; 75/247

[56] References Cited

U.S. PATENT DOCUMENTS

| | | |
|---|---|---|
| 3,943,006 | 3/1976 | Baker et al. . |
| 4,374,761 | 2/1983 | Ray . |
| 4,379,772 | 4/1983 | Solomon et al. . |
| 4,492,670 | 1/1985 | Mizrah et al. . |
| 4,518,705 | 5/1985 | Solomon et al. . |
| 4,544,524 | 10/1985 | Mizrah et al. . |

FOREIGN PATENT DOCUMENTS

| | | |
|---|---|---|
| 10189005 | 7/1998 | Japan . |
| 10189012 | 7/1998 | Japan . |

*Primary Examiner*—Ngoclan Mai
*Attorney, Agent, or Firm*—Anthony Luke Simon

[57] ABSTRACT

The invention is related to a method of manufacturing a platinium electrode that has high porosity and current density of above 10 mA/cm2. The method comprises adding particles of a high temperature fugitive material such as carbon to the platinum ink, and subjecting the mixture to high temperature sintering to remove carbon powder thereby leaving small voids in the platinum.

8 Claims, 1 Drawing Sheet

METHOD OF MANUFACTURING A PLATINUM ELECTRODE

This invention relates to a method of manufacturing a platinum electrode.

BACKGROUND OF THE INVENTION

Many sensors, such as for measuring oxygen in exhaust gases, use platinum as the electrode material because the platinum has high current density and good durability in high temperature environments where it is exposed to vehicle exhaust/gases. Some of these sensors are manufactured using electrolyte and ceramic materials that can be sintered at temperatures as low is 1300 degrees C. Sensors that are manufactured from laminated stacks of alumina, however, require sintering at higher temperatures, for example, around 1500 agrees C. When a platinum electrode material is sintered at 1500 degrees C., challenges develop that don't occur during sintering at 1300 degrees C. Primarily, the platinum electrode material tends to sinter and densify, which decreases its current carrying capacity and its porosity. If the platinum electrode sintered at 1500 degrees C. is used as an oxygen pump for an oxygen sensor, not as much oxygen can be transported through the platinum, lowering its efficiency.

One method for improving the efficiency of the platinum is to add ceramic powder to the platinum ink that is used to form the electrode. For example, if the ink is to be printed on a zirconia body, the ceramic powder is preferably zirconia. This technique has been found to increase the current density of the electrode sintered at 1500 degrees C., for example, from about 1 mA/cm $^2$ to 5 to 7 mA/cm $^2$—when operated at 750 degrees C. But 5 mA/cm$^2$ is still a very inefficient current density.

SUMMARY OF THE INVENTION

It is an object of this invention to provide a method of manufacturing a platinum electrode according to claim 1.

Advantageously this invention provides a method of manufacturing a platinum electrode that has high porosity and high current density even when sintered at temperatures of 1500 degrees C. and higher. For purposes of this invention, high current density means a current density above 10 mA/cm$^2$.

Advantageously, this invention recognizes that the addition of small particles of a high temperature fugitive material to the platinum ink prevents loss of porosity of the platinum during lamination and high temperature sintering. An example appropriate fugitive material is carbon, which oxidizes during the sintering process leaving small voids in the platinum. Advantageously, the voids left by the carbon during sintering guarantee increased porosity of the platinum compared to electrodes formed without the carbon particulates. These voids act as oxygen transfer points used, for example, when the electrode is the conductive material of an oxygen pump in an oxygen sensor.

Advantageously, according to a preferred example, this invention provides a method of manufacturing a platinum electrode comprising the steps of: adding platinum, ceramic, and carbon powders to a vehicle to achieve a printable ink, printing the ink on a body, and sintering the body, wherein the carbon is removed during sintering, wherein a superior porous platinum electrode is achieved.

BRIEF DESCRIPTION OF THE DRAWINGS

The present invention will now be described by way of example with reference to figure in which an example method of fabricating a platinum electrode according to this invention is illustrated.

DETAILED DESCRIPTION OF THE INVENTION

Example One

Figure 1:
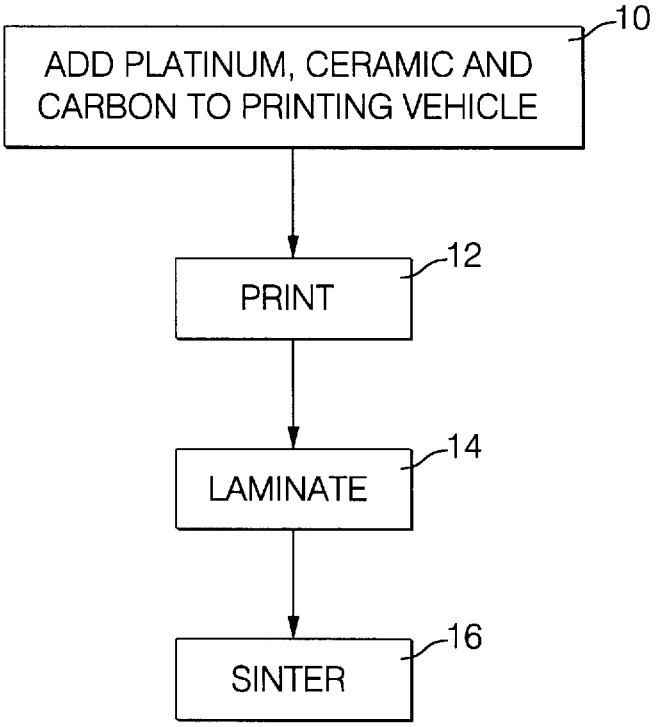

Platinum and zirconia powders of a known type for producing printable platinum inks are mixed with the resultant mixture being 88 percent by weight platinum and 12 percent by weight zirconia. Carbon powder having an average particle size of 0.3 microns is added to the mixture so that the total powder mixture is 51 percent by volume carbon. The powder mixture is next added to an organic vehicle to form a printable ink, which is about 60 percent by weight pine oil and approximately 2% by weight ethyl cellulose. The remainder of the ink comprises the platinum, zirconia and carbon powder mixture.

The ink is printed on a green zirconia body formed by roll compaction. The combination of the green body and printed ink is then fired at 1510 degrees C. The resultant electrode had a current density of 22 mA/cm$^2$ at 750 degrees C. and 74 mA/cm$^2$ at 850 degrees C.

Example Two

A platinum electrode is formed as in example one, except the green zirconia body is laminated to another green zirconia body after printing of the ink and before sintering. The resultant electrode had a current density of 22 mA/cm$^2$ at 750 degrees C. and 64 mA/cm$^2$ at 850 degrees C.

Example Three

A platinum electrode is formed as in example one, except that the green body to which the ink is printed is tape cast. The resultant electrode had a current density of 10 mA/cm$^2$ at 750 degrees C. and 58 mA/cm$^2$ at 850 degrees C.

Example Four

A platinum electrode is formed as in example three, except the green zirconia body is laminated to another green zirconia body after printing of the ink and before sintering. The resultant platinum electrode had a current density of 10 mA/cm$^2$ $^{at}$ 750 C. and 78 mA/cm$^2$ at 850 degrees C.

Example Five

A platinum electrode is formed as in example one, except that it is fired at 1485 degrees C. The electrode had a current density of 34 mA/cm$^2$ at 750 degrees C. and 68 mA/cm$^2$ at 850 degrees C.

Example Six

A platinum electrode is formed as in example two, except that it is fired at 1485 degrees C. The resultant electrode had a current density of 33 mA/cm$^2$ at 750 degrees C. and 69 mA/cm$^2$ at 850 degrees C.

In all the examples above, the ink was printed in three passes. When the ink was printed thicker, with five passes on a roll compacted green body, current densities as high as 43 mA/cm$^2$ were achieved at 750 degrees C. and as high as 86 mA/cm$^2$ were achieved in 850 degrees C.

The above examples compare to a platinum electrode formed from platinum powder and an organic vehicle, which carries a current density of about 1 mA/cm$^2$ after sintering at 1510 degrees C. The above examples also compare to an electrode made with platinum and zirconia powders (no carbon powder) combined with an organic vehicle. After sintering at 1510 degrees C. the electrode yielded a current density ranging from 5 to 7 $mA/cm^2$.

Referring to the figure, example steps for manufacturing a platinum electrode as described above are illustrated. At step 10, the platinum, ceramic and carbon powders are added to an organic vehicle. At step 12, the resultant ink is printed on a green body. At step 14, the green body is laminated to one or more additional green bodies in a known manner as appropriate to construct the desired device, for example, an oxygen sensor. An example suitable oxygen sensor is described U.S. Pat. No. 5,329,806. Because the details of the particular the oxygen sensor with which this invention is used are not central to this invention, they will not been repeated here. At stepped 16, the laminated assembly is sintered to yield the resultant sensor with one or more example platinum electrodes according to this invention thereon.

The amounts of platinum, ceramic and carbon used to form the platinum electrode can be varied. The range of ceramic is typically 3 to 30 percent by weight of the total platinum and ceramic mixture. The range of the carbon is preferably 20 to 60 percent by volume of the platinum, ceramic and carbon powder mixture. The advantages of this invention are particularly noticeable with electrodes sintered in the range of 1400 to 1600 degrees C. where prior platinum electrodes yield poor porosity and poor current density.

While zirconia is the ceramic used above, any ceramic or mixture of ceramics suitable for use in platinum inks can be used.

We claim:

1. A method of manufacturing a platinum electrode comprising the steps of:

adding a mixture of platinum, ceramic and carbon powders to a vehicle to form an ink;

applying the ink to a green body; and sintering the green body and ink to form a platinum electrode, wherein the carbon powder is removed from the ink during the sintering.

2. A method of manufacturing a platinum electrode according to claim 1, wherein the mixture of powders is about 51 percent by volume carbon.

3. A method of manufacturing a platinum electrode according to claim 1, wherein the sintering takes place at a temperature above 1400 degrees C.

4. A method of manufacturing a platinum electrode according to claim 1, wherein the sintering takes place at a temperature above 1500 degrees C.

5. A method of manufacturing a platinum electrode according to claim 1, wherein the green body is laminated to another green body before the step of sintering.

6. A method of manufacturing a platinum electrode comprising the steps of:

mixing platinum, ceramic and carbon powders with a vehicle to form an ink;

applying the ink to a green body; and sintering the green body and ink to form a platinum electrode, wherein the carbon powder is removed from the ink during the sintering and wherein the platinum electrode is porous and has a current density of at least 10 $mA/cm^2$.

7. A method of manufacturing a platinum electrode according to claim 6, wherein the sintering takes place at a temperature above 1400 degrees C.

8. A method of manufacturing a platinum electrode according to claim 6, wherein the sintering takes place at a temperature above 1500 degrees C.

* * * * *